US010836564B2

(12) United States Patent
Kennedy, II

(10) Patent No.: US 10,836,564 B2
(45) Date of Patent: Nov. 17, 2020

(54) PACKAGES FOR THE TRANSPORT OF TUBES

(71) Applicant: The Procter & Gamble Company, Cincinnati, OH (US)

(72) Inventor: John Fitzgerald Kennedy, II, Greensboro, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 243 days.

(21) Appl. No.: 15/051,339

(22) Filed: Feb. 23, 2016

(65) Prior Publication Data

US 2017/0240347 A1 Aug. 24, 2017

(51) Int. Cl.

| | |
|---|---|
| ***B65D 85/14*** | (2006.01) |
| ***B65D 25/10*** | (2006.01) |
| ***B65D 1/02*** | (2006.01) |
| ***B65D 1/26*** | (2006.01) |
| ***B65D 1/40*** | (2006.01) |
| ***B65D 77/04*** | (2006.01) |
| ***B65D 85/30*** | (2006.01) |
| ***B65D 21/02*** | (2006.01) |
| ***B65D 71/70*** | (2006.01) |

(52) U.S. Cl.

CPC ..... *B65D 85/14* (2013.01); *B65D 1/0223* (2013.01); *B65D 1/26* (2013.01); *B65D 1/40* (2013.01); *B65D 21/0209* (2013.01); *B65D 25/10* (2013.01); *B65D 71/70* (2013.01); *B65D 77/0446* (2013.01); *B65D 85/30* (2013.01)

(58) Field of Classification Search

CPC .... B65D 85/14; B65D 71/70; B65D 21/0209; B65D 25/10; B65D 25/106

USPC ..... 206/438, 443, 446, 557, 564, 565

See application file for complete search history.

(56) References Cited

U.S. PATENT DOCUMENTS

| | | | | |
|---|---|---|---|---|
| 3,331,502 | A | 11/1967 | Stroop et al. | |
| 3,390,891 | A | 7/1968 | Stichhan | |
| 3,643,812 | A * | 2/1972 | Mander | B01L 9/06 206/443 |
| 3,747,751 | A * | 7/1973 | Miller | B65D 11/188 206/277 |
| 3,797,648 | A * | 3/1974 | Shaw | B65D 71/00 206/277 |
| 3,904,030 | A | 9/1975 | Repp et al. | |
| 4,235,338 | A | 11/1980 | Dugan et al. | |
| 5,031,761 | A | 7/1991 | De larosiere | |
| 5,471,819 | A | 12/1995 | Weckerle | |
| 5,645,164 | A * | 7/1997 | Hocking | B44D 3/126 206/15.3 |

(Continued)

FOREIGN PATENT DOCUMENTS

| | | |
|---|---|---|
| FR | 1501825 | 11/1967 |
| GB | 1246157 | 9/1971 |
| IN | 2007BO02494 | 7/2011 |

OTHER PUBLICATIONS

International Search Report with Written opinion, dated Mar. 28, 2017, 13 pages.

*Primary Examiner* — Steven A. Reynolds

(74) *Attorney, Agent, or Firm* — Jason J. Camp

(57) ABSTRACT

A tray and cover for storing tubes, such as collapsible tubes. A tray is used to store and transport tubes, the tubes being similarly orientated and arranged side by side in parallel alignment and being held in position by opposing pairs of tray sidewalls. A tray may also be used with a cover.

4 Claims, 13 Drawing Sheets

(56) References Cited

U.S. PATENT DOCUMENTS

| | | | | |
|---|---|---|---|---|
| 5,913,444 | A | 6/1999 | Steiner | |
| 5,967,306 | A | 10/1999 | Umiker | |
| 5,993,745 | A * | 11/1999 | Laska | B01L 9/06 206/446 |
| 6,237,758 | B1 | 5/2001 | Hsu | |
| 6,290,057 | B1 | 9/2001 | Hurley | |
| 6,675,974 | B2 * | 1/2004 | Ballin | B01L 3/5025 210/451 |
| 7,232,038 | B2 * | 6/2007 | Whitney | B01L 9/06 211/74 |
| 7,360,647 | B2 | 4/2008 | Ogg | |
| 8,136,679 | B2 * | 3/2012 | Fry | B01L 3/50855 211/85.18 |
| 9,095,848 | B2 * | 8/2015 | Carrel | A61M 5/002 |
| 9,725,222 | B2 * | 8/2017 | Rossmann | B65D 71/06 |
| 2005/0279651 | A1 | 12/2005 | Perret et al. | |
| 2006/0016156 | A1 * | 1/2006 | Bush | A61M 5/002 53/434 |
| 2009/0100802 | A1 | 4/2009 | Vanderbush et al. | |
| 2014/0131245 | A1 * | 5/2014 | Blanchette | B65D 85/32 206/521.7 |
| 2015/0114871 | A1 | 4/2015 | Fitzpatrick | |
| 2015/0122693 | A1 | 5/2015 | Deutschle et al. | |

* cited by examiner

PACKAGES FOR THE TRANSPORT OF TUBES

FIELD OF THE INVENTION

The present invention relates to improvements in or relating to packaging and particularly relates to a package of tubes and a tray or cover therefor.

BACKGROUND OF THE INVENTION

Collapsible tubes, such as those used for products like toothpaste are normally made of aluminum or of other soft metal or plastic, and consist of a thin body which can be deformed to express the contents of the tube, the body having at one end a shoulder of rather heavier metal which terminates in a central neck to which a cap may be removably secured. Such collapsible tubes, after manufacture, normally have a cap applied to them and are thereafter filled from the opposite end which, at this stage, is open. However, filling is normally carried out in a separate factory from the manufacture of the tube and it is therefore necessary to transport tubes from the place of manufacture to the place where they will be filled. It will be readily appreciated that such tubes in an unfilled condition are relatively delicate, and have to be packed very carefully for transport purposes to avoid the danger of accidental deformation, which would make them unsuitable for the intended use.

Typically the type of package used to transport such tubes has comprised either an open cardboard container or a container having within it a grid structure by means of which individual tubes are maintained in separate cells, both of which allow for substantial shift of the tubes within the container or the warping of one or more of the container's sides. Such shifting or warping can later affect the tube filling process, as the tube gripping machinery may crush the tubes, the cardboard container, or both. The object of the present invention is to provide a package of collapsible tubes, which is more effective than the conventional packaging, reduces tube damage, and which can be reused.

SUMMARY OF THE INVENTION

A tray for holding one or more tubes is provided that comprises a tray which is of rectangular or square outline having, a substantially flat bottom wall including one or more protrusions; the protrusions having a base and a frusto-conical portion; sidewalls; wherein at least one sidewall has an arcuate recess.

A storage package for holding one or more tubes is provided that comprises a tray which is of rectangular or square outline having, a substantially flat bottom wall including one or more protrusions; the protrusions having a base and a frusto-conical portion; sidewalls, wherein at least one sidewall has an arcuate recess; a cover which is of rectangular or square outline that is inter-connectable with the tray to form an interior compartment having; a substantially flat top wall including one or more protrusions; sidewalls, wherein at least one sidewall has an arcuate recess.

A stack of storage packages is provided which comprises a top storage package and a bottom storage package each of which comprise a tray which is of rectangular or square outline having; a substantially flat bottom wall including one or more protrusions; the protrusions having a base and a frusto-conical portion; opposite each protrusion is a reverse frusto-conical portion; sidewalls, wherein at least one sidewall has an arcuate recess; a cover which is of rectangular or square outline that is inter-connectable with the tray to form an interior compartment having; a substantially flat top wall including one or more protrusions; opposite each protrusion is an indentation; sidewalls, wherein at least one sidewall has an arcuate recess; wherein the top storage package is stacked on the bottom storage package, such that the tray protrusions of the top storage package fit within complementary indentations on the bottom storage package cover.

DETAILED DESCRIPTION OF THE INVENTION

The present invention comprises a tray and cover for storing tubes, such as collapsible tubes. A tray is used to store and transport tubes, the tubes are similarly orientated and arranged side by side in parallel alignment, and held in position by opposing pairs of tray sidewalls. A tray may also be used with a cover; the cover interconnects with a tray and has one or more indentations, each giving rise to a corresponding protrusion shaped to project into the open end of a tube, in such a manner as to retain the tube in its correct position and provide support against accidental deformation. Each tray may also have one or more protrusions, each protrusion being shaped to project into one or more indentations present on a cover upon which the tray is stacked.

As used herein, the word "or" when used as a connector of two or more elements is meant to include the elements individually and in combination; for example X or Y, means X or Y or both.

Figure 1:
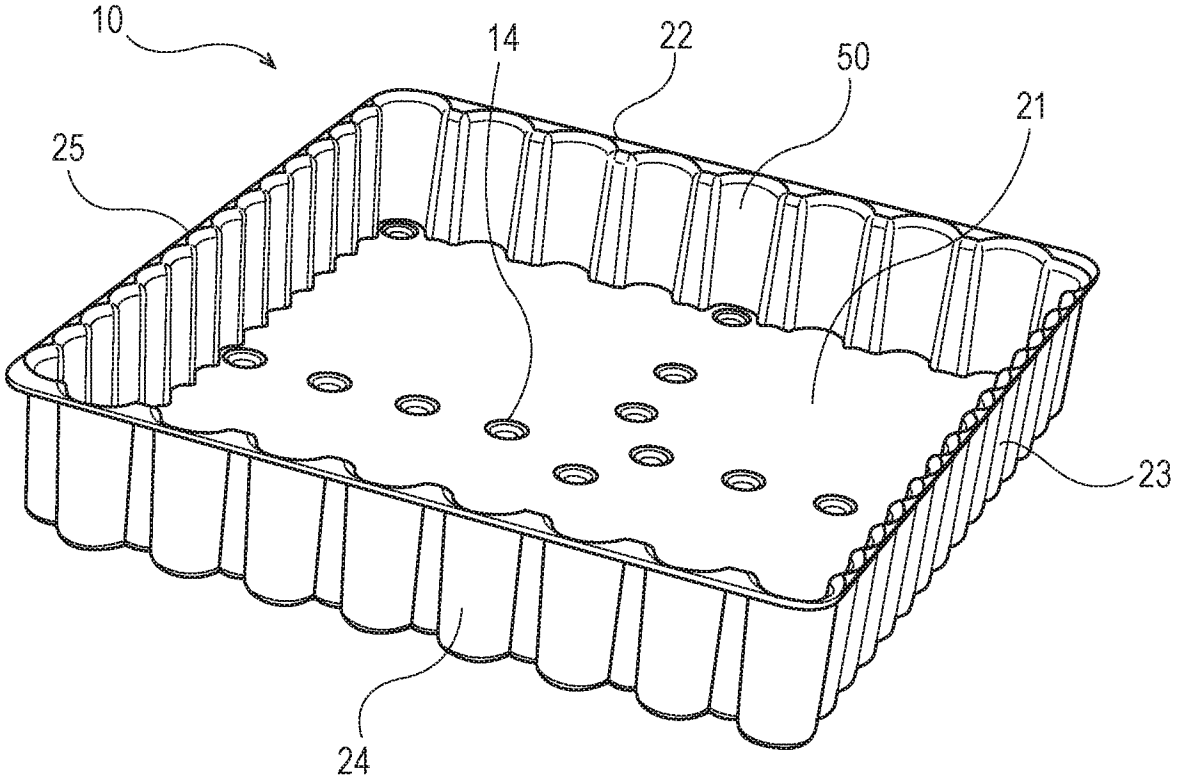
FIG. 1 is a perspective view of a tray from the present invention.
Figure 3:
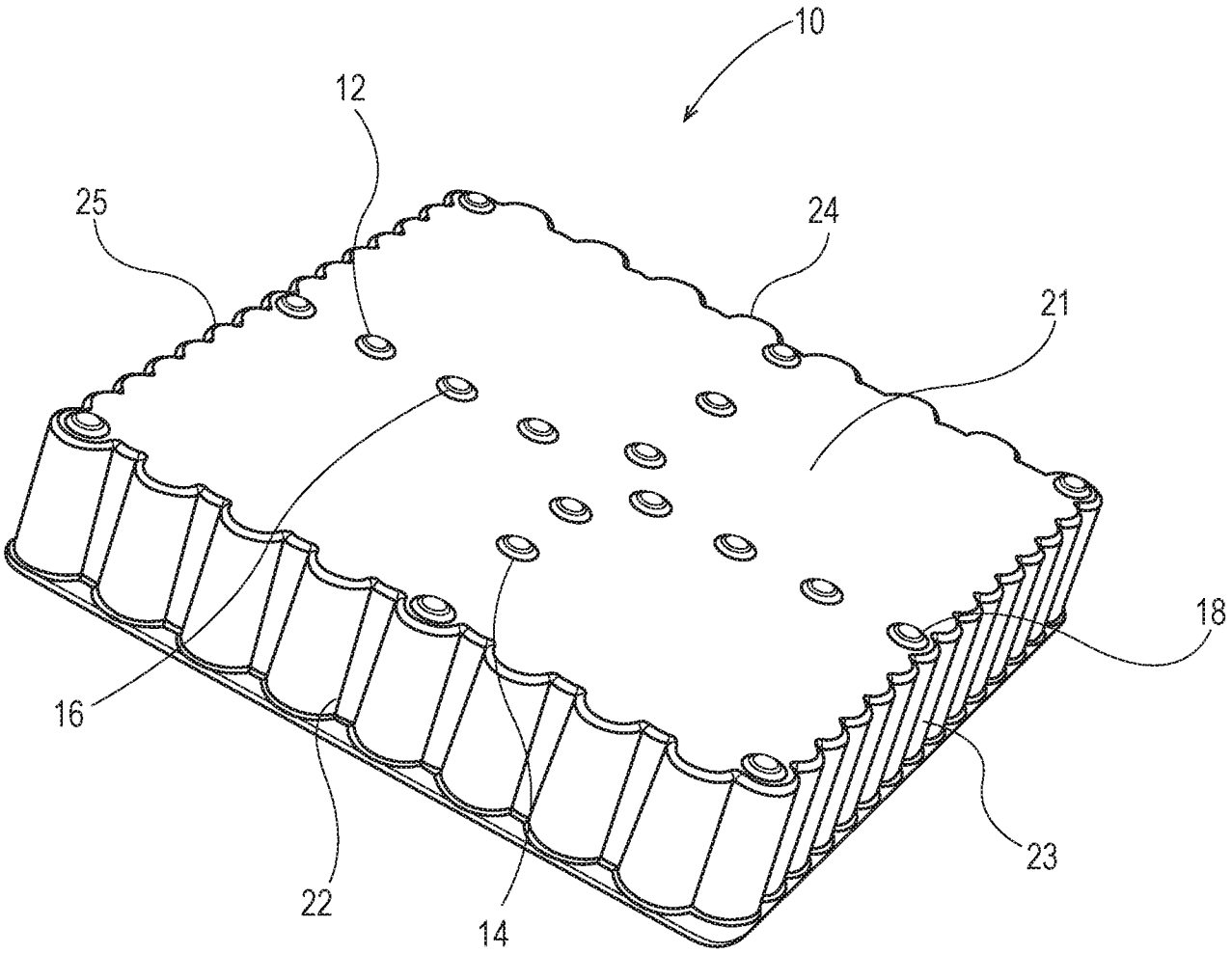
FIG. 3 is an inverted perspective view of a tray from the present invention.
Figure 4:
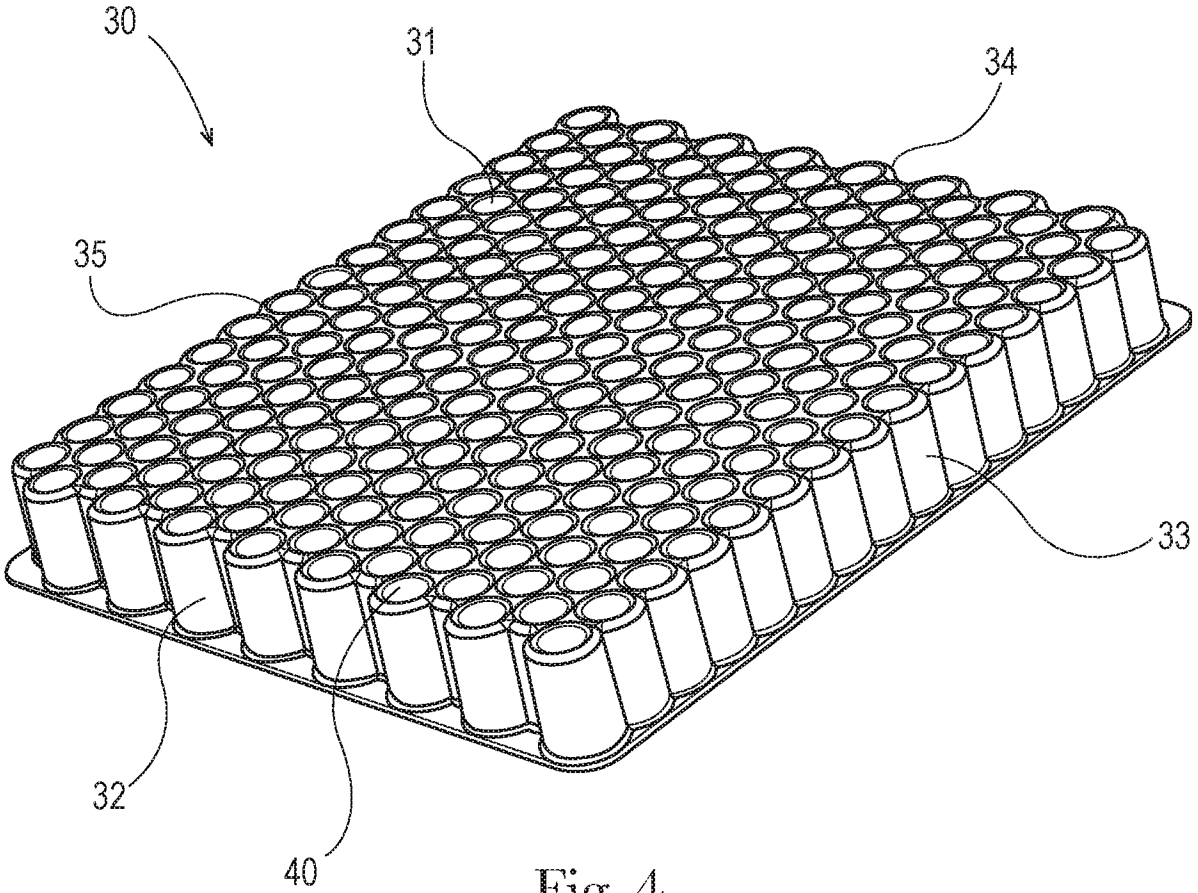
FIG. 4 is a perspective view of a cover from the present invention.
Figure 5:
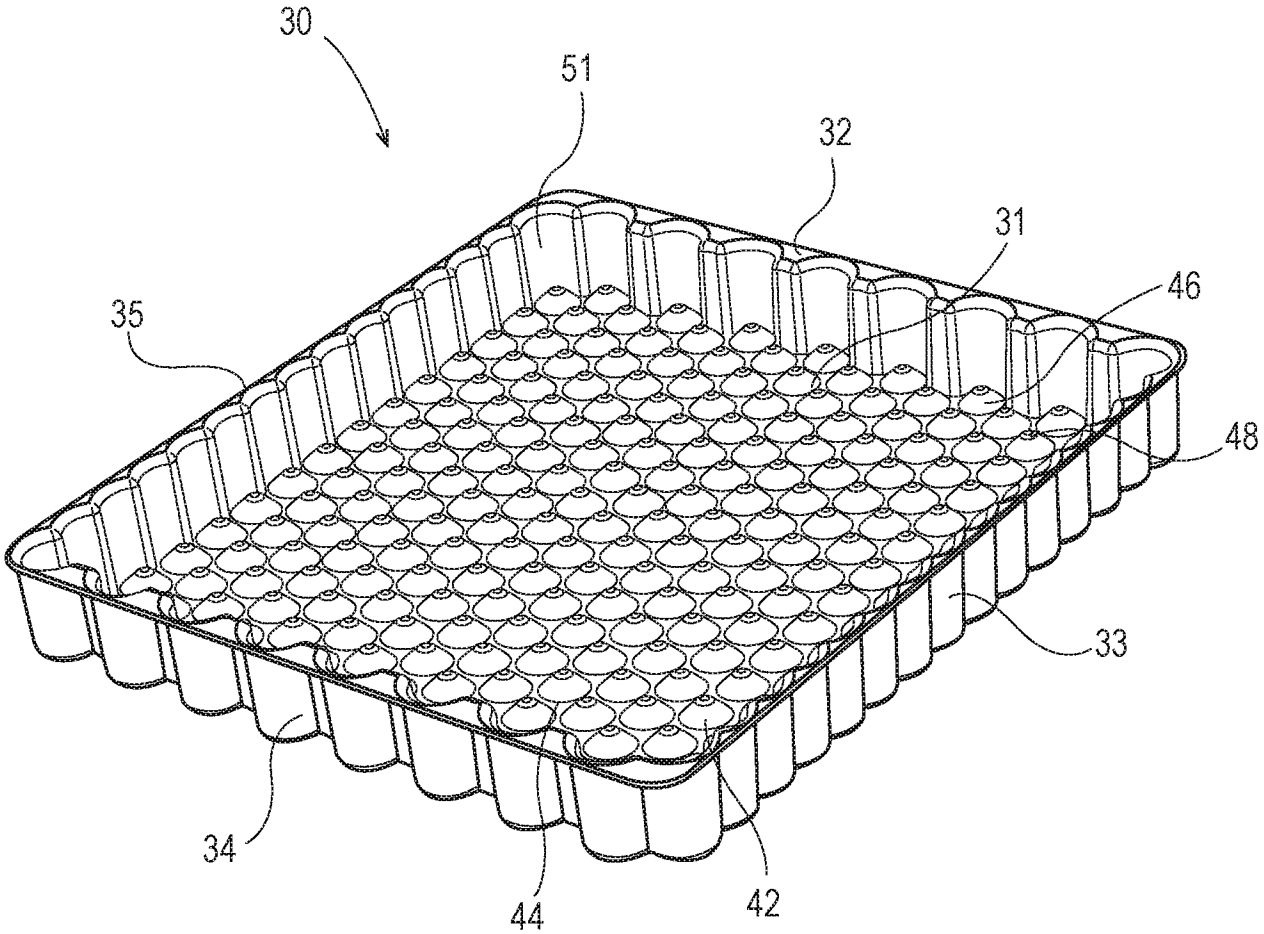
FIG. 5 is an inverted perspective view of a cover from the present invention.
Figure 6:
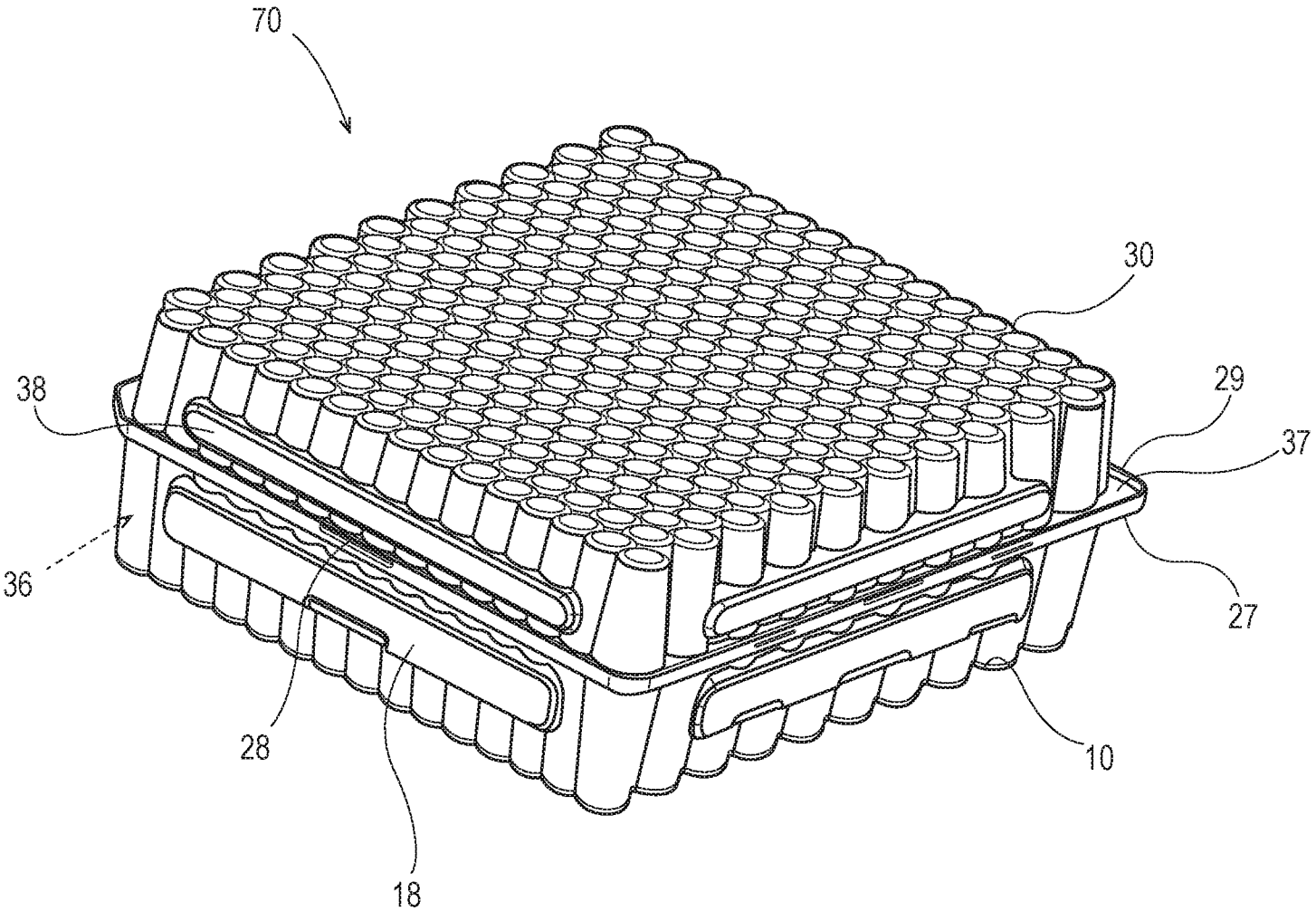
FIG. 6 is a perspective view of a storage package from the present invention.

The following figures illustrate examples of the present invention. FIGS. 1 and 3 are perspective views of a tray 10 (FIG. 3 is an inverted perspective view) according to the invention. FIGS. 4 and 5 are perspective views of a cover 30 (FIG. 5 is an inverted perspective view) designed to interconnect with a tray 10. A storage package 70, as shown in FIG. 6, is formed when a tray 10 is interconnected with a cover 30 to form an interior compartment 36, for the storage of one or more tubes.

FIGS. 1 and 3 illustrate, a tray 10 which is of rectangular or square outline corresponding to the size and shape required by tube filling machinery, while the height of a tray corresponds to the length of the tubes being transported. A tray 10 has a bottom wall 21 and two pairs of opposing side walls 22, 24 and 23, 25. A tray 10 is rectangular or square in plan and is sized so that a cover 30 may be interconnected with it to define an interior compartment 36, as shown in FIG. 6. In the embodiment shown in FIG. 6 the cover 30 is intended to nest within the tray 10, although other embodiments of the present invention may reverse the relationship. The tray is made, for example by vacuum moulding, from rigid or semi-rigid thin plastic sheet material; the sheet material may be opaque, translucent, or transparent, and as seen from above comprises, as shown in FIGS. 1 and 3, a substantially flat bottom wall 21, with one or more protrusions 12 that may be organized in any fashion, such as in rows. A tray may comprise one or more of the following materials, such as acrylonitrile butadiene styrene, polyvinyl chloride, high impact polystyrene, polyethylene terephthalate, polycarbonate, acrylic, or high density polyethylene. The sidewalls 22, 23, 24 and 25 are formed integrally with the bottom wall 21 and extend upwardly from it. The protrusions 12 are shaped, so as to have a base 14 which is semi-circular or circular in horizontal cross section. Extending away from the base 14 and in opposite direction from the sidewalls 22, 23, 24 and 25; and in certain embodiments in the same or similar horizontal cross section as the base 14, is a frusto-conical portion 16 which may be closed at its distal end 18.

Figure 7:
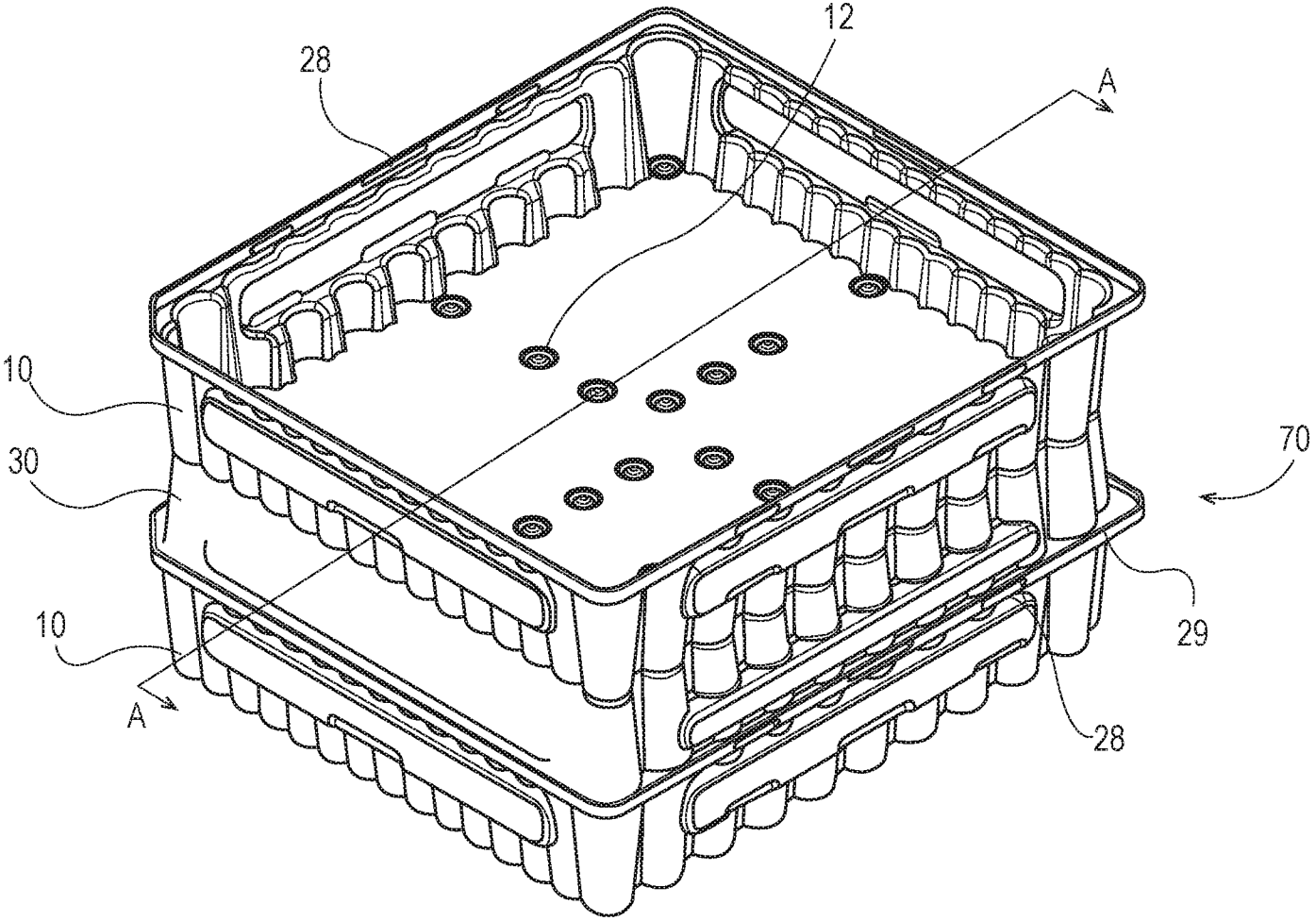
FIG. 7 is a perspective view of a storage package stack from the present invention.
Figure 7A:
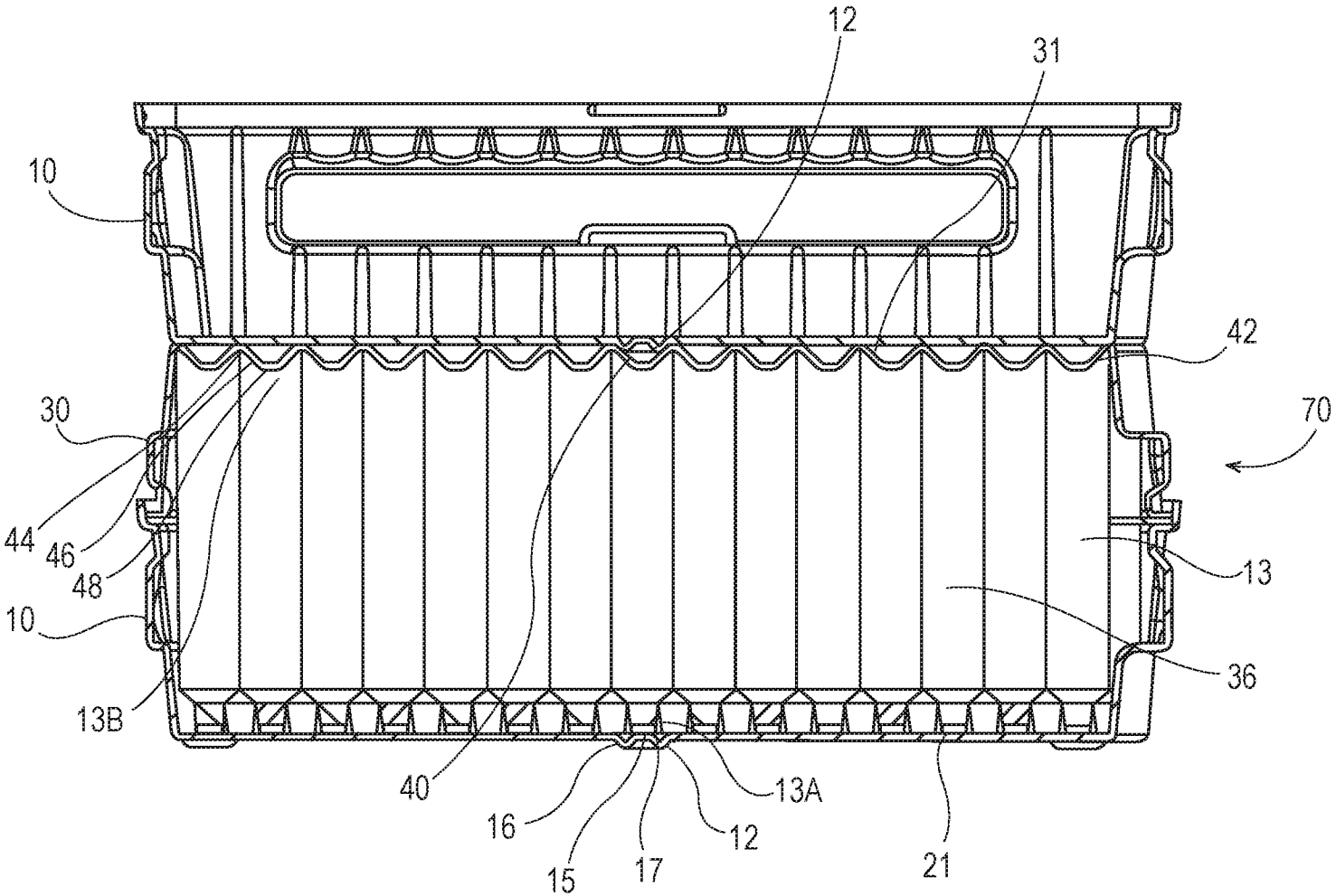
FIG. 7A is a sectional view along line A-A of FIG. 7.

A protrusion 12, as shown in FIGS. 3, 7 and 7A may be shaped to complement (when two or more storage packages 70 are stacked on top of each other, or as shown in FIGS. 7 and 7A when a tray 10 is stacked on top of the cover 30 of a storage package 70) a corresponding indentation 40 on the top wall 31 of a corresponding cover 30, and the shape of the indentations 40 is such that at least a portion of a protrusion 12 fits within the indentation 40. Such a complementary fit between a protrusion 12 and indentation 40 allows for the stacking of two or more storage packages 70 and forms a stable platform by substantially reducing the lateral movement of the storage packages 70.

Figure 2:
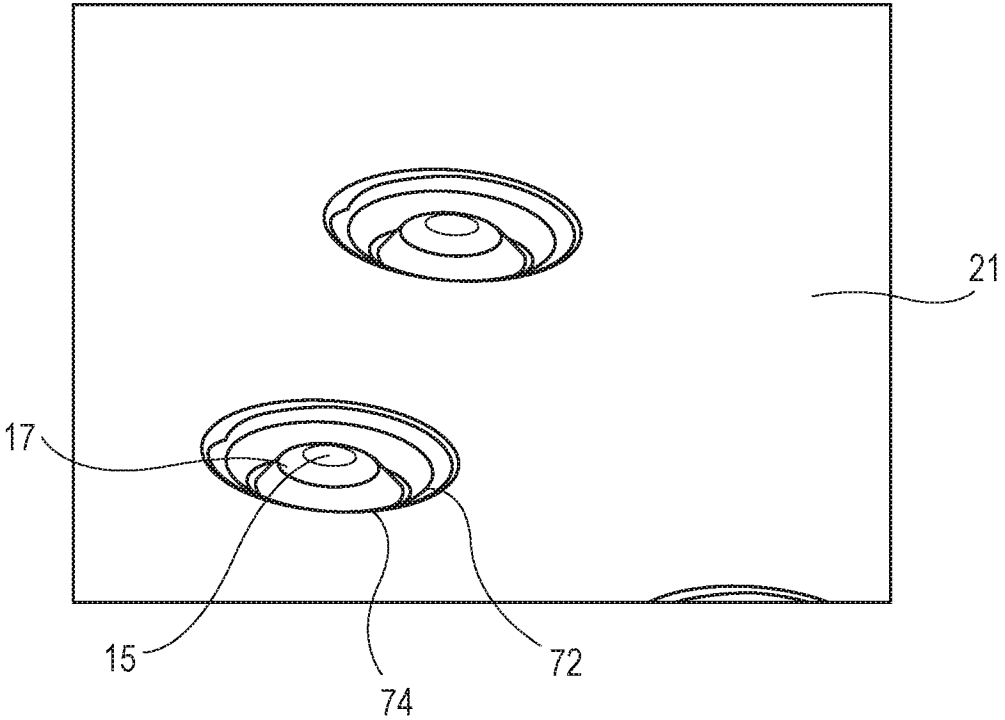
FIG. 2 is a close-up perspective view of a tray from the present invention.

As shown in FIGS. 2 and 7A, a protrusion 12 may also have a reverse frusto-conical portion 17 extending in the opposite direction from the frusto-conical portion 16, so end portion 15 of the reverse frusto-conical portion 17 is substantially flush with the bottom wall 21 of the tray. Further, the protrusions 12 are positioned on the bottom wall 21, such that the closed end of a tube 13A, such as a toothpaste cap, rests on the end portion 15 of a reverse frusto-conical portion 17, thereby allowing the tubes 13 positioned over protrusions 12 to have substantially the same height as tubes 13 not positioned over protrusions 12, which reduces the chance of tubes being out of position or snagged and deformed during the tube filling process.

FIGS. 4 and 5 show a cover 30 which has a rectangular or square outline to complement the size and shape of a tray 10, so as to be inter-connectable and form an interior compartment. A cover 30 has a top wall 31 and two pairs of opposing side walls 32, 34 and 33, 35, integrally formed with the top wall 31 and extending downwardly from it, as shown in FIG. 4. The cover is made, for example by vacuum moulding, from rigid or semi-rigid thin plastic sheet material; the sheet material may be opaque, translucent, or transparent, and as seen from above (FIG. 5) comprises a substantially flat top wall 31, with one or more protrusions 42 that may be organized in any fashion, such as in rows. A cover may comprise one or more of the following materials, such as acrylonitrile butadiene styrene, polyvinyl chloride, high impact polystyrene, polyethylene terephthalate, polycarbonate, acrylic, or high density polyethylene. The protrusions 42 are shaped, so as to have a base 44 which is semi-circular or circular in horizontal cross section. Extending away from the base 44 in the same direction as the sidewalls 32, 33, 34 and 35; and in certain embodiments having the same or similar horizontal cross section as the base 44, is a frusto-conical portion 46 which may be closed at its distal end 48. As shown in FIG. 7A, a protrusion 42 may be shaped such that the base 44 and/or the frusto-conical portion 46 will project within an open end 13B of a tube 13, such as a toothpaste tube, to be carried in the storage package 70, thus serving not only to orient the open end 13B of the tube 13 in its correct position in the interior compartment 36, but also to give the open end 13B of the tube 13 some protection against distortion or collapse. Opposite the protrusions 42 along the top wall 31 are one or more indentations 40 (FIGS. 4 and 7A). As noted previously, the shape of the indentations 40 is such that at least a portion of a tray protrusion 12 fits within an indentation 40. Such a complementary fit between a protrusion 12 and indentation 40 allows for the stacking of two or more storage packages 70 and forms a stable platform by substantially reducing the lateral movement of the storage packages 70, as shown in FIG. 7.

A tray 10, cover 30 or both may have one or more arcuate recesses 50, 51 respectively, extending into the periphery of the tray 10 or cover 30, as shown in FIGS. 1 and 5. Each recess is sized to receive a curved side portion of a tube 13. The recesses 50, 51 engage the curved side portion of a tube 13. The recesses 50, 51 control and maintain the alignment and position of the tubes 13 within the interior compartment 36, minimizing any shifting or tilting of the tubes 13 during transport or storage.

Figure 8:
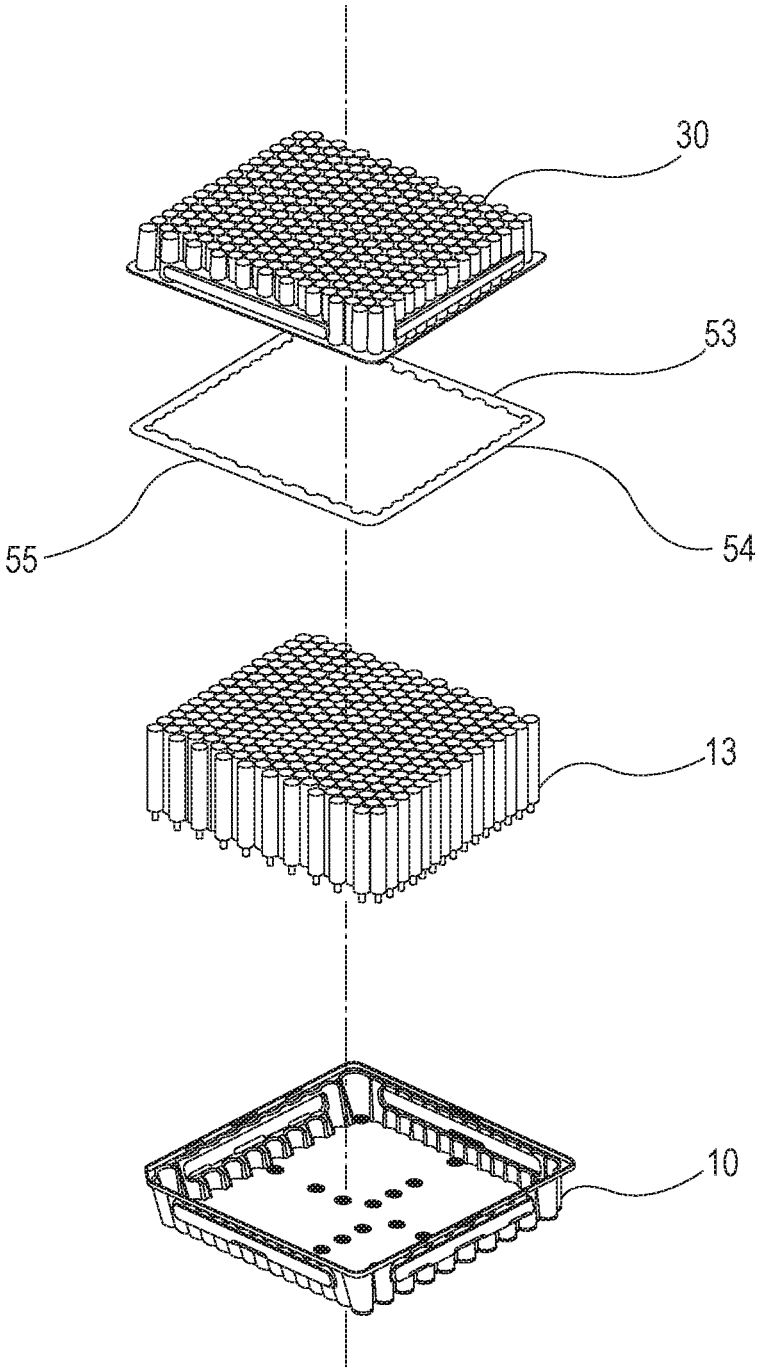
FIG. 8 is a blown up perspective view of a storage package from the present invention.
Figure 9:
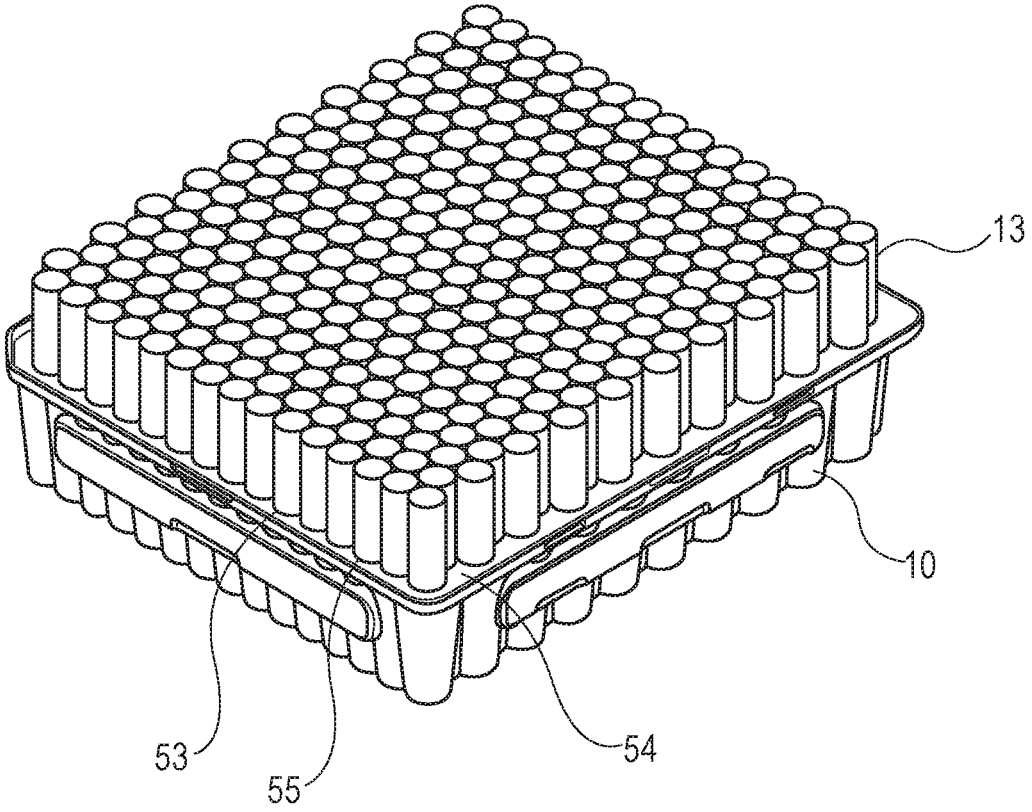
FIG. 9 is a perspective view of a tray from the present invention.

A tray 10 may also comprise a stabilizer 54, as shown in FIGS. 8 and 9. A stabilizer 54 is an essentially flat component that is either square or rectangular in plan, so as to nest around the periphery of the tray 10, although in certain embodiments of the present invention a stabilizer may nest in the cover or both the cover and tray. The stabilizer has one or more arcuate recesses 53 along its inner edge 55. Each recess 53 is sized to receive a curved side portion of a tube 13. The recesses 53 engage the curved side portion of a tube 13. The stabilizer 54 functions to prevent tubes from tipping when a tray or storage package is positioned at an angle, for example when a tray is loaded into a tube filling process. A stabilizer is particularly useful when the sides of a tray, cover or both are outwardly angled; so as to create an increasing gap between a tube wall and the side wall the further the tube extends away from the tray bottom wall or the cover top wall. A stabilizer may be formed from one or more of the following materials, such as acrylonitrile butadiene styrene, polyvinyl chloride, high impact polystyrene, polyethylene terephthalate, polycarbonate, acrylic, or high density polyethylene.

Figure 10:
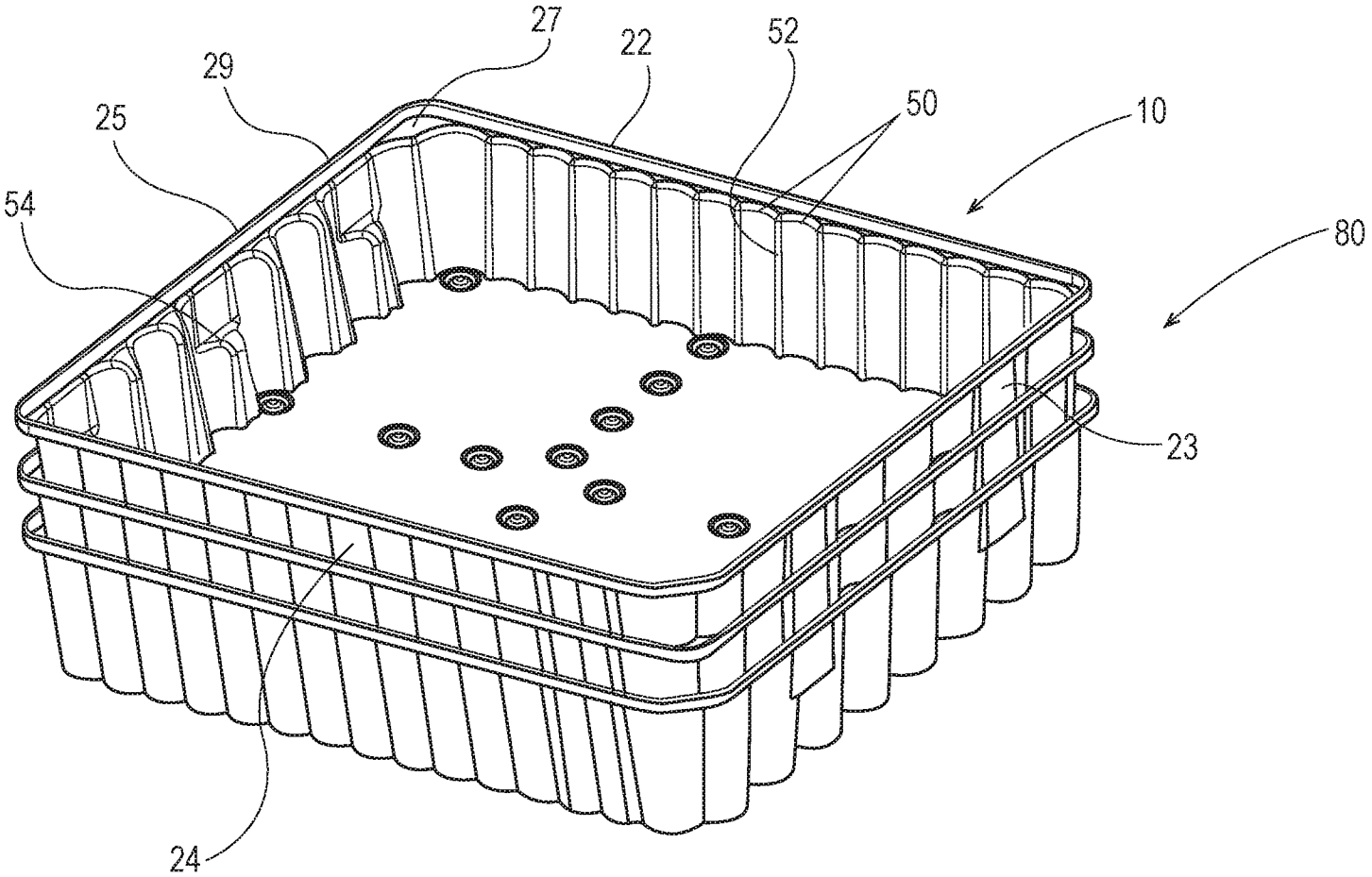
FIG. 10 is a perspective view of a tray stack from the present invention.
Figure 11:
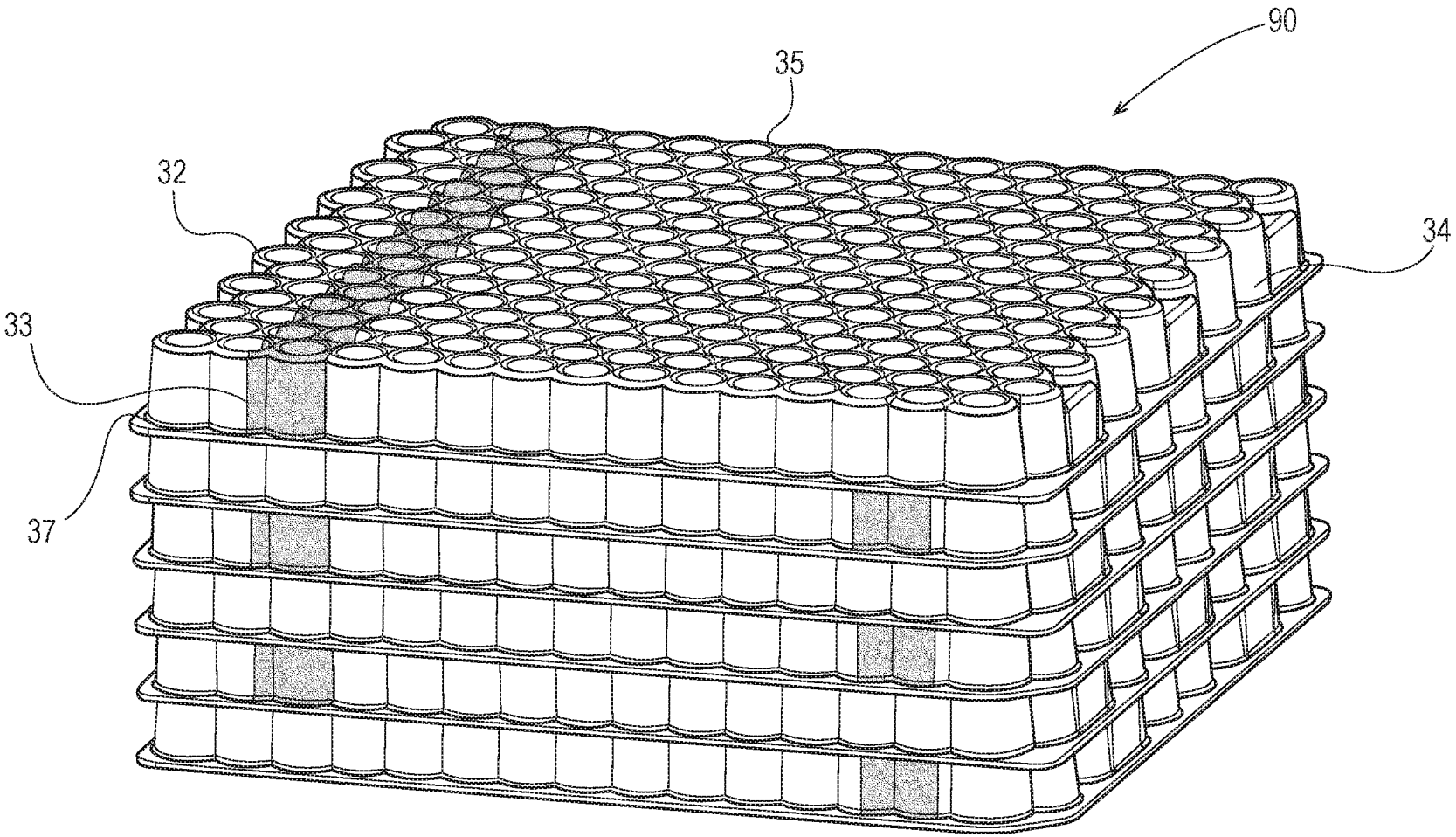
FIG. 11 is a perspective view of a cover stack from the present invention.

As noted above, and shown in FIGS. 1 and 3-5 the sidewalls of the tray 22, 23, 24 and 25, the sidewalls of the cover 32, 33, 34 and 35, or both may be outwardly flared from the bottom wall 21 and top wall 31 respectively. The outward flare of the side walls allows the trays to be stacked 80, as shown in FIG. 10 and the covers to be stacked 90, as shown in FIG. 11. Further, as shown in FIG. 10, in a tray 10, at the intersection of two adjacent arcuate recesses 50 a ridge 52 is formed. One or more of the ridges 52 may have notched ridges 54; in certain embodiments each side wall 22, 23, 24 and 25 would have one or more notched ridges. The notched ridges prevent trays or covers from getting stuck together when stacked (inducing vacuum). It should be noted that while FIG. 10 shows notched ridges in a tray, notched ridges may also be present in a cover.

The tray side walls 22, 23, 24 and 25 or cover side walls 32, 33, 34 and 35 at their edges may be turned outward to form a tray flange 27 or a cover flange 37, as shown in FIGS. 10 and 11. A flange serves to reinforce the tray or cover and defines a bumper for contact with adjacent cases. In addition, as the flange is at the edge of the tray or cover it can provide a hand grip for lifting. Further, the outer edge of the flange 27 may also extend vertically to form a lip 29. A lip 29 serves to hold a complementary tray or, as shown in FIG. 6, a cover 30 in place such that the complementary tray or cover is prevented from lateral or vertical movement that would disassociate the complementary tray or cover, which is especially important during transportation of the storage packages. In certain embodiments the flange and lip are dimensioned to accept a complementary flange, such that the complementary flange nests within the flange and lip, as shown in FIG. 6. While FIG. 6 shows the tray 10 having a flange 27 and lip 29, with a cover flange 37 nesting within the tray flange 27 and lip 29, it is still within the scope of the present invention for a cover to also have a flange and lip. Further, as shown in FIGS. 6 and 7 a lip 29 may have one or more grooves 28, which inwardly extend from the lip 29 towards the interior compartment 36 a sufficient distance such that when a cover 30 is nested within a tray 10 it is secured; in that the cover flange 37 can pass over the one or more grooves 28, yet the grooves 28 can prevent the cover 30 from being unsecured from the tray 10 absent the application of some outside force, such as by a human or machine.

Figure 12:
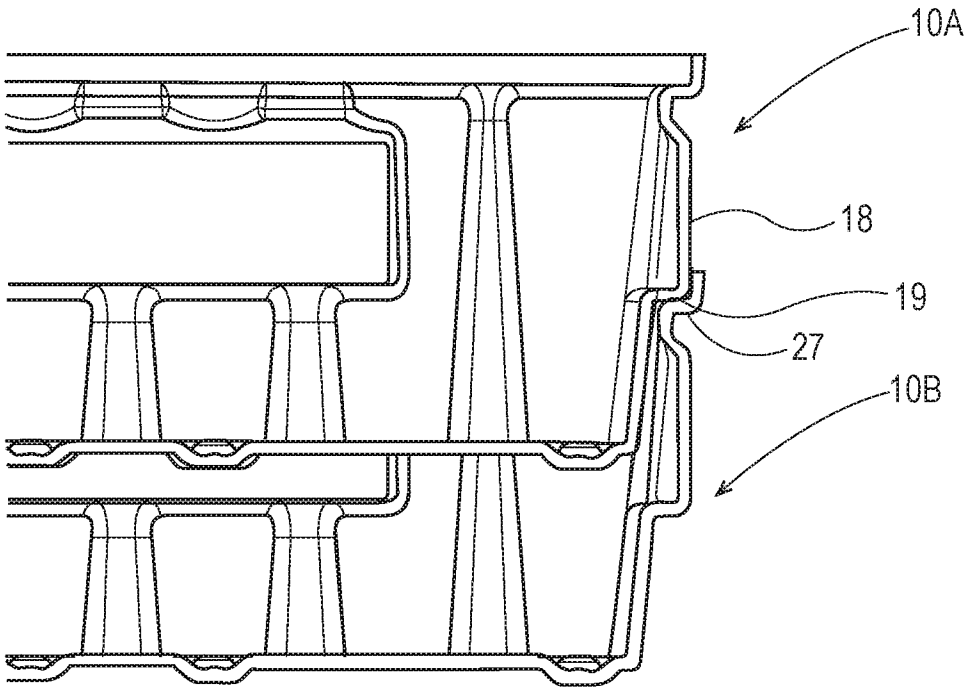
FIG. 12 is a close up sectional view of a tray stack from the present invention.

FIG. 6 shows a tray or cover may have one or more tray bars 18 or cover bars 38, respectively. The tray bars 18 and cover bars 38 function to strengthen the tray 10 and the cover 30. Each of the tray bars and cover bars are integral with their respective side wall and extend outwardly therefrom and along the length of the side wall. In addition to their function of strengthening the tray and cover, bars 18, 38 enable a machine to use suction cups or some other type of "end affector" to grab the trays, covers, or both. Further, when trays or covers are stacked; in this instance trays 10A, 10B, as shown in FIG. 12 the bottom edge 19 of a side bar 18 can rest on a flange 27 to prevent a tray 10A from becoming fully nested in another tray 10B, thereby reducing the chance of forming a vacuum and reducing surface area contact between the trays 10A, 10B; making it easier to separate stacked trays.

Tubes generally begin the tube filling process having an open end and a closed end, with the open end being exposed for the filling of the tube. In certain embodiments tubes, for example collapsible tubes may be formed from aluminum or of other flexible metal or plastic, and consist of a sleeve-like body which can be deformed to express the contents of the tube, the body having at one end a shoulder of rather heavier material, which terminates in a central neck to which a cap may be removably secured. Such collapsible tubes, after manufacture, normally have a cap applied to them thereby creating a closed end and an open end from which the tube may be filled.

A. A tray for holding one or more tubes comprising a tray which is of rectangular or square outline having; a substantially flat bottom wall including one or more protrusions; the protrusions having a base and a frusto-conical portion; sidewalls; wherein at least one sidewall has an arcuate recess.

B. The tray of paragraph A wherein the one or more protrusions are closed at their distal end.

C. The tray of paragraph A or B wherein the protrusions comprise one or more reverse frusto-conical portions, preferably wherein the one or more reverse frusto-conical-portions have an end portion that is substantially flush with the bottom wall.

D. The tray according to any of paragraphs A to C wherein the sidewalls outwardly flare from the bottom wall, preferably wherein the tray comprises a stabilizer which is shaped to nest around the periphery of the tray, more preferably wherein the stabilizer has an inner edge comprising one or more arcuate recesses.

E. The tray according to any of paragraphs A to D wherein the sidewalls have at least one notched ridge.

F. A storage package for holding one or more tubes comprising a tray which is of rectangular or square outline having; a substantially flat bottom wall including one or more protrusions; the protrusions having a base and a frusto-conical portion; sidewalls, wherein at least one sidewall has an arcuate recess; a cover which is of rectangular or square outline that is inter-connectable with the tray to form an interior compartment having; a substantially flat top wall including one or more protrusions; sidewalls, wherein at least one sidewall has an arcuate recess.

G. The storage package of paragraph F wherein the tray protrusions comprise one or more reverse frusto-conical portions, preferably wherein the one or more reverse frusto-conical-portions have an end portion that is substantially flush with the bottom wall.

H. The storage package of paragraph G comprising one or more tubes having an open and closed end, the tubes being similarly oriented arranged side by side, preferably wherein the one or more tubes are held in position at the closed end by the bottom wall and reverse frusto-conical end portions, at the open end by a corresponding cover protrusion, each protrusion being shaped to project into the open end of the tube, and along the side of the tubes by the cover and tray arcuate recesses.

I. The storage package according to paragraph G wherein the tray sidewalls outwardly flare from the bottom wall and the cover sidewalls outwardly incline from the top wall, preferably wherein the tray comprises a stabilizer which is shaped to nest around the periphery of the tray, more preferably wherein the stabilizer has an inner edge comprising one or more arcuate recesses.

J. The storage package of paragraph I comprising one or more tubes having an open and closed end, the tubes being similarly oriented arranged side by side, preferably wherein one or more tubes are held in position at the closed end by the bottom wall and reverse frusto-conical end portions, at the open end by a corresponding cover protrusion, each protrusion being shaped to project into the open end of the tube, and along the side of the tubes by the stabilizer inner edge arcuate recesses.

K. The storage package of paragraph F, wherein the tray sidewalls comprise a flange and lip and the cover sidewalls comprise a flange that is nested within the tray flange and lip, preferably wherein the tray lip comprises a groove.

L. A stack of storage packages comprising a top storage package and a bottom storage package each of which comprise a tray which is of rectangular or square outline having; a substantially flat bottom wall including one or more protrusions; the protrusions having a base and a frusto-conical portion; opposite each protrusion is a reverse frusto-conical portion; sidewalls, wherein at least one sidewall has an arcuate recess; a cover which is of rectangular or square outline that is inter-connectable with the tray to form an interior compartment having; a substantially flat top wall including one or more protrusions; opposite each protrusion is an indentation; sidewalls, wherein at least one sidewall has an arcuate recess; wherein the top storage package is stacked on the bottom storage package, such that the tray protrusions of the top storage package fit within complementary indentations on the bottom storage package cover.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any 10 invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A storage package for holding one or more unfilled toothpaste tubes comprising:

a tray which is of rectangular or square perimeter, wherein the tray comprises:

a substantially flat bottom wall including one or more protrusions;

the one or more protrusions having a base, a frusto-conical portion, and a reverse frusto-conical portion having an end that is substantially flush with the bottom wall;

sidewalls, wherein at least one sidewall has an arcuate recess controlling and maintaining alignment and position of the tubes within the interior compartment;

a cover which is of rectangular or square perimeter that is inter-connectable with the tray to form an interior compartment, wherein the cover comprises:

a substantially flat top wall including one or more cover protrusions;

sidewalls, wherein at least one sidewall has an arcuate recess;

one or more unfilled toothpaste tubes having an open and closed end, the unfilled toothpaste tubes being similarly oriented arranged side by side, wherein the one or more unfilled toothpaste tubes are held in position at the closed end by the bottom wall and reverse frusto-conical end portions, at the open end by a corresponding protrusion of the one or more cover protrusions, each of the one or more cover protrusions being shaped to project into the open end of the tube, and along the side of the tubes by the cover and tray arcuate recesses;

wherein the tray and cover differ from one another, such that the tray sidewalls comprise a flange and lip and the cover sidewalls comprise a flange that can be nested within the tray flange and lip;

wherein the tray sidewalls outwardly flare from the bottom wall and the cover sidewalls outwardly incline from the top wall; and a stabilizer which is shaped to nest around the periphery of the tray and having an inner edge comprising one or more arcuate recesses, which is sized to receive a curved side portion of a tube.

2. The storage package of claim 1, wherein the tray lip comprises a groove.

3. A stack of storage packages comprising a top storage package and a bottom storage package according to claim 1, wherein the top storage package is stacked on the bottom storage package, such that the tray protrusions of the top storage package fit within complementary indentations on the bottom storage package cover.

4. The storage package of claim 1, wherein the one or more unfilled toothpaste tubes are collapsible.

* * * * *